US011467521B1

(12) United States Patent
Sone

(10) Patent No.: US 11,467,521 B1
(45) Date of Patent: Oct. 11, 2022

(54) FIXING DEVICE

(71) Applicant: TOSHIBA TEC KABUSHIKI KAISHA, Tokyo (JP)

(72) Inventor: Toshihiro Sone, Yokohama Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/470,297

(22) Filed: Sep. 9, 2021

(51) Int. Cl.
*G03G 15/20* (2006.01)

(52) U.S. Cl.
CPC ..... *G03G 15/206* (2013.01); *G03G 15/2025* (2013.01); *G03G 15/2064* (2013.01)

(58) Field of Classification Search
CPC ..... G03G 15/206; G03G 15/2025
See application file for complete search history.

(56) References Cited

U.S. PATENT DOCUMENTS

| | | | | |
|---|---|---|---|---|
| 10,031,452 | B2 * | 7/2018 | Suzuki | G03G 15/2053 |
| 10,761,461 | B2 * | 9/2020 | Morimoto | G03G 15/2064 |
| 10,990,046 | B2 * | 4/2021 | Watatani | G03G 15/2064 |
| 2011/0085832 | A1 * | 4/2011 | Hasegawa | G03G 15/2032 399/329 |
| 2011/0135353 | A1 * | 6/2011 | Creteau | G03G 15/2025 399/329 |
| 2014/0161499 | A1 * | 6/2014 | Ueda | G03G 15/206 399/329 |
| 2015/0093167 | A1 * | 4/2015 | Hazeyama | G03G 15/2064 399/329 |
| 2017/0010572 | A1 | 1/2017 | Amano | |
| 2018/0011434 | A1 * | 1/2018 | Adachi | G03G 15/2025 |
| 2020/0387094 | A1 * | 12/2020 | Yamaguchi | G03G 15/2025 |

FOREIGN PATENT DOCUMENTS

| | | | |
|---|---|---|---|
| JP | H09101695 | A | 4/1997 |
| JP | 2008224875 | A | 9/2008 |
| JP | 2014228857 | A | 12/2014 |
| JP | 2018018045 | A | 2/2018 |
| JP | 2020020881 | A | 2/2020 |
| JP | 2020106675 | A | 7/2020 |

* cited by examiner

*Primary Examiner* — Sevan A Aydin
(74) *Attorney, Agent, or Firm* — Kim & Stewart LLP

(57) ABSTRACT

A fixing device for an image forming apparatus has a tubular fixing member that has a lubricant-coated inner surface. A rotating member contacts an outer surface of the fixing member. A heater is on an inner surface side of the fixing member at a first position. A pressing member presses against the inner surface of the fixing member at a second position. The pressing member extends beyond the outer edges of the fixing member and includes first grooves in an outward facing surface that contacts the inner surface of fixing member. At least one first groove has end portion that extends beyond an outer edge of the fixing member, an inner portion inside the outer edges of the fixing member, and connecting portion connecting the two other portions. The connector portion is angled inward toward a center of the fixing member and crosses the outer edge of the fixing member.

20 Claims, 5 Drawing Sheets

FIXING DEVICE

FIELD

Exemplary embodiments described herein relate to a fixing device for image forming apparatuses or the like.

BACKGROUND

In a fixing device provided in an image forming device a belt, a film, or the like that has a small heat capacity and thus can be heated in a short period of time is used as a fixing member. A rotating member is in contact with an outer peripheral surface of the fixing member so that the fixing member can be rotationally driven. In addition, a pressing member presses an inner peripheral surface of the fixing member, and presses the fixing member towards the outer peripheral side. The inner peripheral surface of such a fixing member is coated with a lubricant (oil or grease) in order to reduce sliding friction between the inner peripheral surface and the pressing member. In such a fixing device, it is required to prevent the leakage of the lubricant applied to the inner peripheral surface of the fixing member even when the fixing member being rotationally driven.

DETAILED DESCRIPTION

In general, according to one embodiment, a fixing device for an image forming apparatus or the like, includes a fixing member having a tubular or cylindrical shape and an inner surface coated with lubricant. A rotating member such as a roller or the like is configured to contact an outer surface of the fixing member and cause the fixing member to rotate. A heating member is on an inner surface side of the fixing member at a first position and configured to heat the fixing member. A pressing member is configured to press outward against the inner surface of the fixing member at a second position separated from the first position. The pressing member extends in a longitudinal direction beyond the outer edges of the fixing member. The pressing member includes a plurality of first grooves in an outward facing surface that contacts the inner surface of fixing member. The plurality of first grooves includes at least one first groove that has: an outer extension end portion that extends beyond an outer edge of the fixing member, an inner extension end portion at a position inside the outer edges of the fixing member, and an extension portion connecting the outer extension end portion and the inner extension end portion. The extension portion includes an angled portion that is angled inward toward a center of the fixing member in the longitudinal direction. The angled portion is angled towards a downstream direction of the fixing member along a rotational direction of the fixing member. The extension portion crossing the outer edge of the fixing member.

Hereinafter, certain example embodiments will be described with reference to the drawings.

Figure 1:
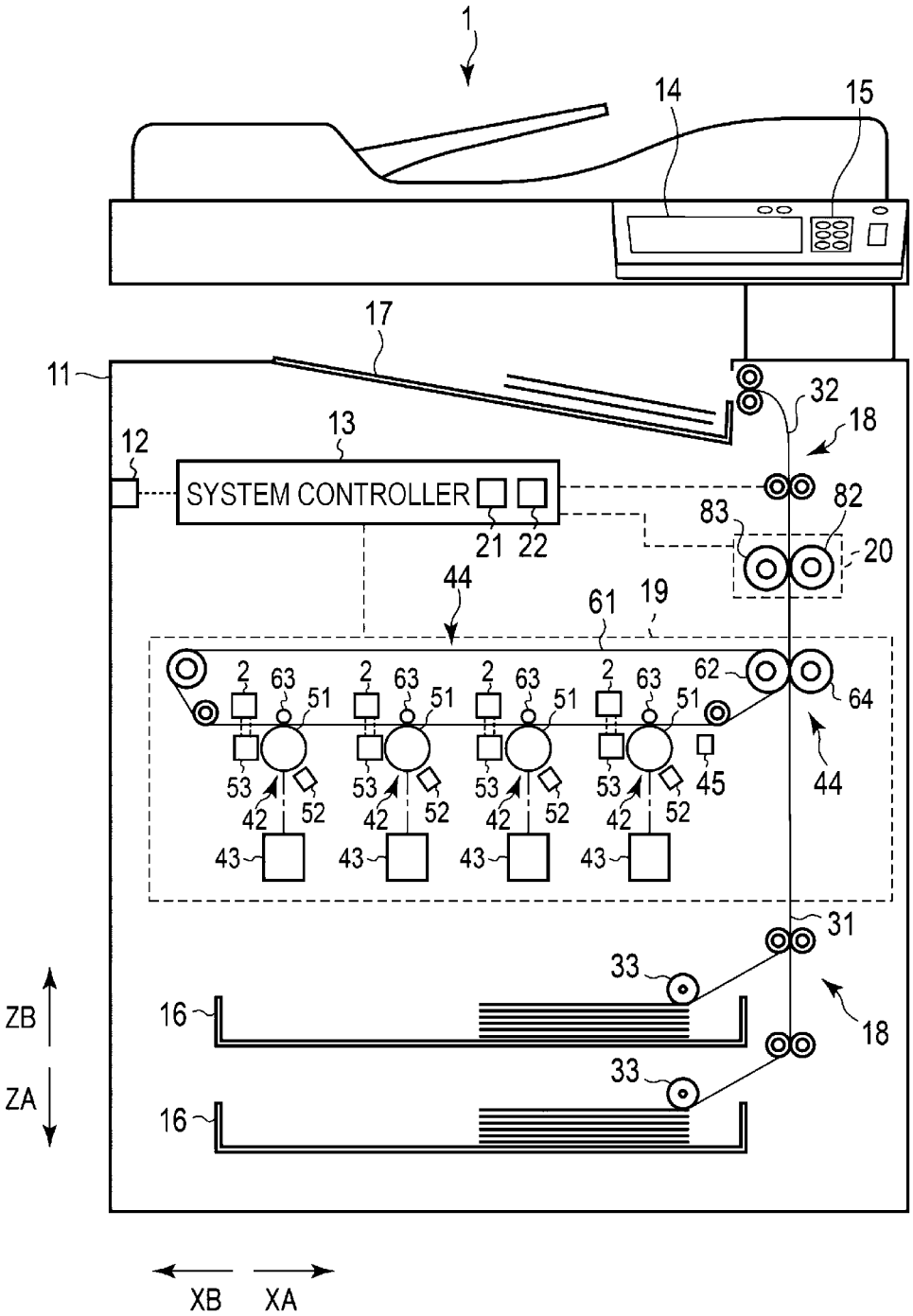
FIG. 1 is a schematic diagram illustrating an image forming device including a fixing device according to an embodiment.

FIG. 1 is a schematic diagram illustrating an image forming device 1 including a fixing device 20 according to an embodiment. The image forming device 1 is, for example, a multifunction printer (MFP) that performs various processes such as forming an image on a recording medium (e.g., sheet of paper) that is conveyed within the MFP. The image forming device 1 forms an image on a recording medium by using a toner supplied from a toner cartridge 2. For example, the image forming device 1 receives toner from a plurality of toner cartridges 2 and forms images on a recording medium with each of the received toners. The plurality of toner cartridges 2 store toners of different colors such as cyan, magenta, yellow, and black.

In the description of image forming device 1, the vertical direction (corresponding in this example to the direction of gravity direction) includes the directions indicated by an arrow ZA (down) and an arrow ZB (up), a width direction (orthogonally or substantially orthogonally) to the vertical direction includes the directions indicated by an arrow XA and an arrow XB, and a depth direction into the page of FIG. 1 that is orthogonally or substantially orthogonally to both of the vertical and width direction are defined for the purposes of explanation.

As illustrated in FIG. 1, the image forming device 1 includes a housing 11, a communication interface 12, a system controller 13, a display unit 14, an input operation interface 15, a paper feed cassette 16, a paper discharge tray 17, a conveyance mechanism 18, an image forming unit 19, and a fixing device 20.

The housing 11 is a main body of the image forming device. The housing 11 includes the communication interface 12, the system controller 13, the display unit 14, the input operation interface 15, the paper feed cassette 16, the paper discharge tray 17, the conveyance mechanism. 18, the image forming unit 19, and the fixing device 20.

The communication interface 12 is an interface that relays and permits communication with other (external) devices. The communication interface 12 is used, for example, for communication with the client terminal ("client"). The client can be an information processing device such as a personal computer, a smartphone, or a tablet PC. The communication interface 12 may wirelessly communicate with the client according to a standard such as Bluetooth® or Wi-fi®.

The system controller 13 controls the image forming device 1. The system controller 13 includes, for example, a processor 21 and a memory 22. The processor 21 is an arithmetic element that performs arithmetic processes. The processor 21 is, for example, a central processing unit (CPU). The processor 21 performs a process based on data such as a program stored in the memory 22. The processor 21 configured by a program (software) or the like stored in memory 22 functions as a control unit or controller that can perform various operations.

The memory 22 is a storage medium that stores a program, data to be used in the program, and the like. The memory 22 functions as a working memory for the processor 21. That is, the memory 22 temporarily stores data during the processing of the processor 21, a program being executed by the processor 21, and the like.

The processor 21 controls, for example, transmission and reception of data by the communication interface 12, the screen display of the display unit 14, input operations from the input operation interface 15, conveyance of a recording medium by the conveyance mechanism 18, an image forming process by the image forming unit 19, and a fixing process by the fixing device 20.

The processor 21 generates a printing job based on an image data obtained from an external device via the communication interface 12 or the like. The processor 21 stores the generated printing job in the memory 22. The printing job includes image data indicating the image to be formed on the recording medium. The image data from the external device may be data for forming an image on one recording medium or may be data for forming an image several recording mediums. The printing job includes information indicating that the printing is a color printing or a monochrome printing.

The processor 21 functions as a controller (an engine controller) that controls operations of the conveyance mechanism 18, the image forming unit 19, and the fixing device 20 by executing a program stored in the memory 22. That is, the processor 21 controls conveyance of the recording medium by the conveyance mechanism 18, forming of an image on a recording medium by the image forming unit 19, and fixing of the image to the recording medium by the fixing device 20.

The image forming device 1 may include an engine controller separately from the system controller 13. For example, the image forming device 1 may include separate engine controllers respectively corresponding to the conveyance mechanism 18, the image forming unit 19, and the fixing device 20. That is, the image forming device 1 may include one engine controller that controls the conveyance of a recording medium by the conveyance mechanism 18, another engine controller that controls the formation of an image on a recording medium by the image forming unit 19, and yet another engine controller that controls the fixation of an image to the recording medium by the fixing device 20, respectively. In this case, the system controller 13 supplies information required for the control by the engine controllers to the engine controllers and coordinates the overall operation of the separate engine controllers as necessary.

The display unit 14 includes a display that displays a screen in response to the input of a video signal. For example, screens for various kinds of entering or adjusting the settings of the image forming device 1 can be displayed on the display of the display unit 14.

The input operation interface 15 includes an input device (control panel, keypad, control buttons) that generates an operation signal based on an input operation from a user.

The paper feed cassette 16 stores recording media (e.g., sheets of paper). The paper feed cassette 16 can be extracted from the housing 11 to permit a user to add recording media to the cassette.

The paper discharge tray 17 is a tray that supports a recording medium after it has been discharged from the image forming device 1.

The conveyance mechanism 18 supplies a recording medium for printing to the image forming unit 19 and then discharges the recording medium on which an image has been formed from the housing 11. The conveyance mechanism 18 includes a paper feed conveyance path 31 and a paper discharge conveyance path 32. The paper feed conveyance path 31 takes in a recording medium from the paper feed cassette 16 to the image forming unit 19. The paper feed conveyance path 31 includes a pickup roller 33 for each paper feed cassette 16. The pickup roller 33 takes the recording medium in the paper feed cassette 16 and supplies it onward to the paper feed conveyance path 31. The paper discharge conveyance path 32 is a conveyance path that discharges a recording medium from the housing 11. The paper discharge tray 17 supports a recording medium after it has been discharged from the paper discharge conveyance path 32.

The image forming unit 19 forms an image on the recording medium. The image forming unit 19 forms an image on a recording medium, for example, based on a printing job generated by the processor 21. The image forming unit 19 includes a plurality of processing units 42, a plurality of exposure devices 43, and a transfer mechanism 44. The plurality of processing units 42 are provided for each of the type of toners provided in the image forming apparatus 1. For example, one of the processing units 42 is provided for the different toner colors of cyan, magenta, yellow, and black. The toner cartridges 2 including the toners of different colors are respectively connected to the corresponding processing units 42. Since the plurality of processing units 42 have the same configurations, one processing unit 42 is described as representative.

A processing unit 42 includes a photosensitive drum 51, a charging charger 52, and a developing device 53. The photosensitive drum 51 is a photosensitive body that comprises a cylindrical drum and a photosensitive layer provided on the outer peripheral surface of the drum. The photosensitive drum 51 rotates at a constant speed. The charging charger 52 uniformly charges the surface of the photosensitive drum 51. The charging charger 52 charges the photosensitive drum 51 to a uniform negative electrode potential by applying a voltage to the photosensitive drum 51. The developing device 53 disposes the toner on the photosensitive drum 51. The developing device 53 includes a developer container, a stirring mechanism, a developing roller, a doctor blade, and the like.

The developer container is a container that receives and stores the toner sent out from the toner cartridge 2. The carrier is placed in the developer container in advance of the toner arrival. The stirring mechanism mixes the toner from the toner cartridge 2 with the carrier. The mixture can be referred to as developer. The carrier is placed in the developer container, for example, at the time of manufacturing of the developing device 53. The developer is disposed on the surface of the development roller by the rotation of the development roller in the developer container. The doctor blade is separated from the surface of the development roller by a small gap. The doctor blade removes a portion of the developer disposed on the surface of the rotating development roller. Accordingly, a thin layer of the developer is formed on the surface of the development roller. The thickness of the layer of the developer is substantially the distance left between the doctor blade and the surface of the development roller.

The exposure device 43 includes a plurality of light emitting elements. Each light emitting element is, for example, a light emitting diode. The exposure devices 43 forms a latent image on the photosensitive drum 51 by the selective irradiation of the charged photosensitive drum 51 with light emitted from a light emitting element. Each light emitting element irradiates one point of the photosensitive drum 51 with the light. The plurality of light emitting elements are arranged in a row along a main scanning direction (the direction along the rotation axis of the photosensitive drum 51). The exposure device 43 forms a latent image line-by-line on the photosensitive drum 51 by irradiating the photosensitive drum 51 with the light by the plurality of light emitting elements. By the continuous irradiation of the rotating photosensitive drum 51 with the light from the plurality of light emitting elements, the exposure device 43 forms a latent image comprising a plurality of lines on the photosensitive drum 51.

After the electrostatic latent image is formed on the photosensitive drum 51, the layer of the developer on the surface of the development roller comes close to surface of the photosensitive drum 51 and toner included in the developer adheres to the electrostatic latent image formed on the surface of the photosensitive drum 51. Accordingly, a toner image is formed on the surface of the photosensitive drum 51. In this manner, the photosensitive drum 51 can function as an image carrier that stores the toner image disposed according to the electrostatic latent image.

The transfer mechanism 44 transfers the toner image formed on the surface of the photosensitive drum 51 to the recording medium. The transfer mechanism 44 includes a primary transfer belt 61, a secondary transfer facing roller 62, a plurality of primary transfer rollers 63, and a secondary transfer roller 64. The primary transfer belt 61 is an endless belt wound around the secondary transfer facing roller 62 and a plurality of winding rollers. The inner peripheral surface of the primary transfer belt 61 is in contact with the secondary transfer facing roller 62 and the plurality of winding rollers, and the outer peripheral surface thereof is in contact with the photosensitive drum 51 of each processing unit 42.

The secondary transfer facing roller 62 conveys the primary transfer belt 61 in a predetermined conveyance direction by rotation. The plurality of winding rollers can freely rotate. The plurality of winding rollers rotate by the movement of the primary transfer belt 61 caused by the secondary transfer facing roller 62. The plurality of primary transfer rollers 63 cause the primary transfer belt 61 to be in contact with the photosensitive drums 51 of the plurality of processing units 42, respectively. The plurality of primary transfer rollers 63 face the corresponding photosensitive drums 51 of the plurality of processing units 42, respectively. The primary transfer belt 61 is disposed between the plurality of primary transfer rollers 63 and the plurality of processing units 42. The primary transfer rollers 63 are in contact with the inner peripheral surface of the primary transfer belt 61 and press the primary transfer belt 61 to the photosensitive drum 51 side. Accordingly, the primary transfer rollers 63 cause the outer peripheral surface of the primary transfer belt 61 to be in contact with the photosensitive drums 51.

The secondary transfer roller 64 faces the secondary transfer facing roller 62. The primary transfer belt 61 passes through the secondary transfer roller 64 and the secondary transfer facing roller 62. The secondary transfer roller 64 is in contact with the outer peripheral surface of the primary transfer belt 61 and presses the outer peripheral surface of the primary transfer belt 61 to the secondary transfer facing roller 62 side. Accordingly, the secondary transfer roller 64 presses against the secondary transfer facing roller 62 and the outer peripheral surface of the primary transfer belt 61 to form a transfer nip. Therefore, the secondary transfer roller 64 presses against the recording medium that passes through the transfer nip. The recording media thus presses against the primary transfer belt 61 (and the toner image formed thereon) at the transfer nip. The secondary transfer roller 64 and the secondary transfer facing roller 62 convey the recording medium onward. Accordingly, the recording medium eventually passes entirely through the transfer nip.

When the outer peripheral surface of the primary transfer belt 61 is in contact with the photosensitive drum 51, the toner image formed on the surface of the photosensitive drum 51 is transferred to the outer peripheral surface of the primary transfer belt 61. When the image forming unit 19 includes a plurality of processing units 42, the primary transfer belt 61 can receive a toner image from each of the photosensitive drums 51 of the plurality of processing units 42. The toner images transferred to the outer peripheral surface of the primary transfer belt 61 are conveyed to the transfer nip at which the secondary transfer roller 64 and the outer peripheral surface of the primary transfer belt 61 are tightly in contact with each other with the primary transfer belt 61 pressed therebetween. The toner image that was transferred to the outer peripheral surface of the primary transfer belt 61 will be transferred to the recording medium if there is a recording medium at the transfer nip when the toner image arrives.

FIGS. 2 to 5 are schematic diagrams illustrating a fixing device 20 according to an embodiment. The fixing device 20 fixes the toner image to the recording medium by melting (fusing) the toner that was transferred to the recording medium. The fixing device 20 includes an exterior body 81, a rotating portion 82, and a fixed portion 83.

In FIG. 2 to FIG. 5, the vertical directions, the width directions, and the depth directions of the image forming device 1 are defined in the same manner as in FIG. 1. In addition, in the fixing device 20, directions taking the sheet conveyance direction as a reference frame are defined. That is the forward and reverse directions along the conveyance path of the recording medium are indicated by an arrow ZC and an arrow ZD, page width directions are indicated by an arrow YA and an arrow YB, and sheet thickness (or out of sheet plane directions orthogonal or substantially orthogonal to the conveyance directions (referred to below as width directions) and the page width directions (referred to below as a longitudinal directions) are indicated by an arrow XC and an arrow XD.

In the examples of FIGS. 2 to 5, the sheet conveyance directions within the fixing device 20 are identical or substantially identical to the vertical directions. The sheet thickness directions of the fixing device 20 are identical or substantially identical to the XA and XB directions of the image forming device 1. The page width directions (YA, YB) of the fixing device 20 are identical or substantially identical to the depth directions of the image forming device 1.

Figure 2:
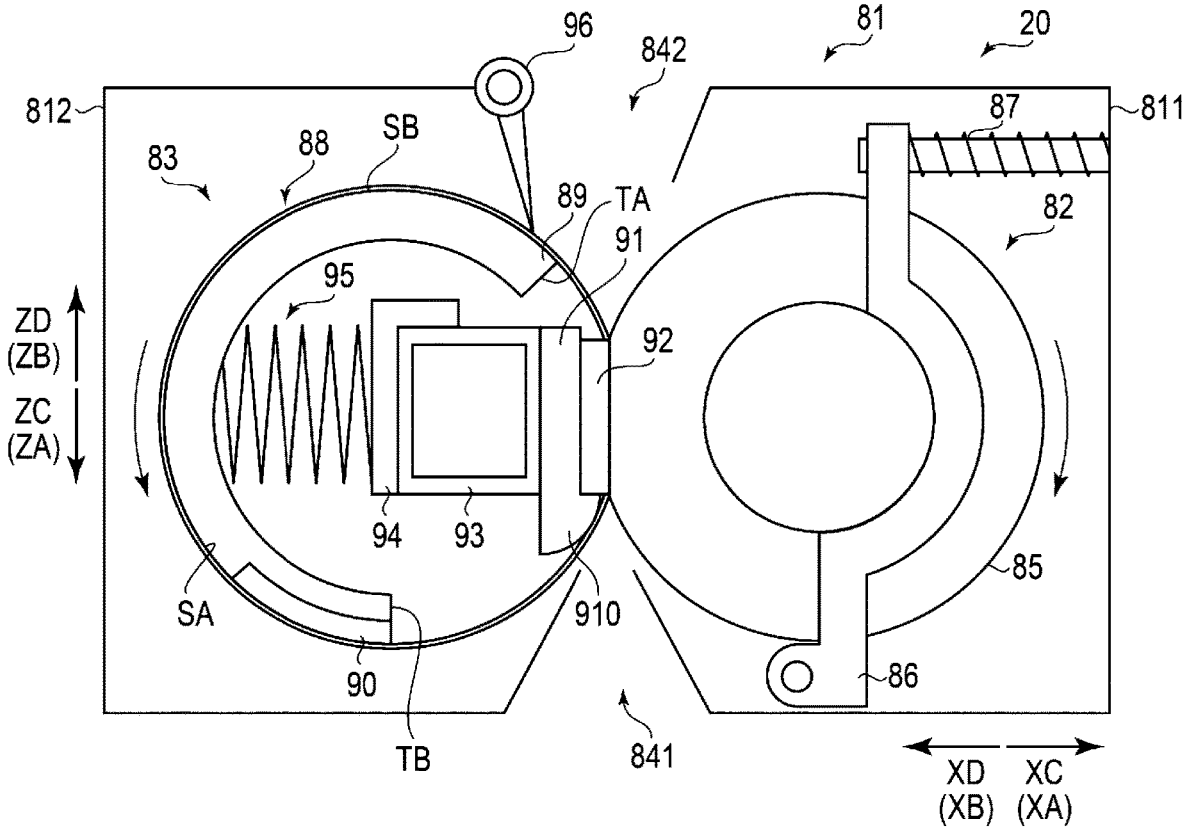
FIG. 2 is a schematic diagram illustrating a fixing device from one direction.
Figure 3:
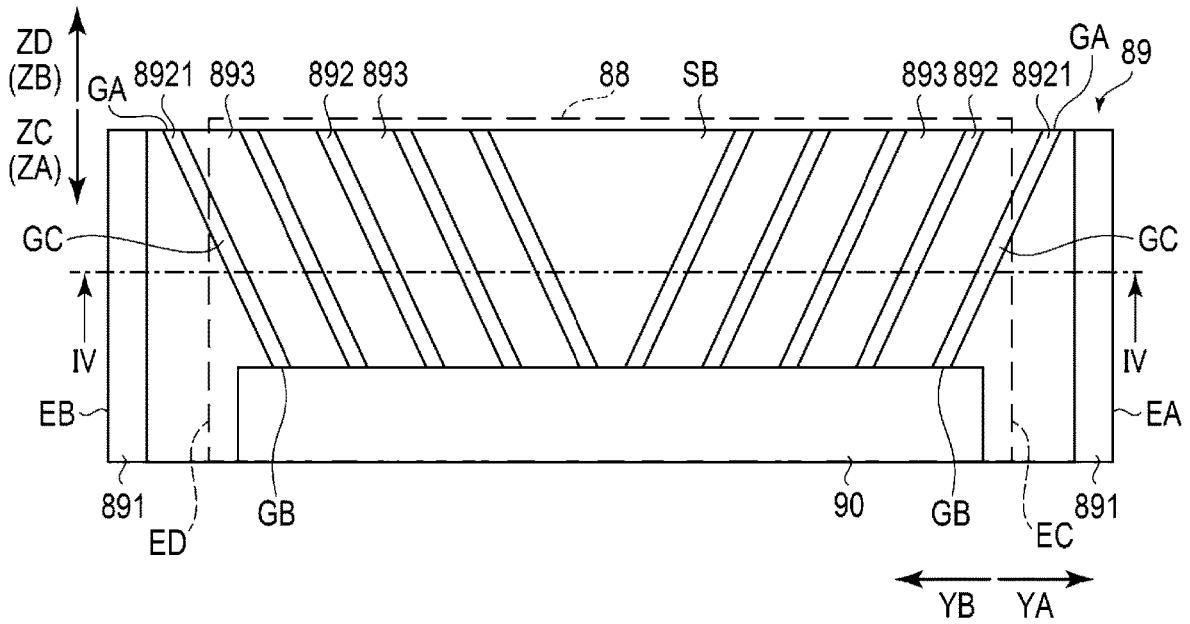
FIG. 3 is a schematic diagram schematically illustrating the fixing device from another with the exterior body omitted.
Figure 4:
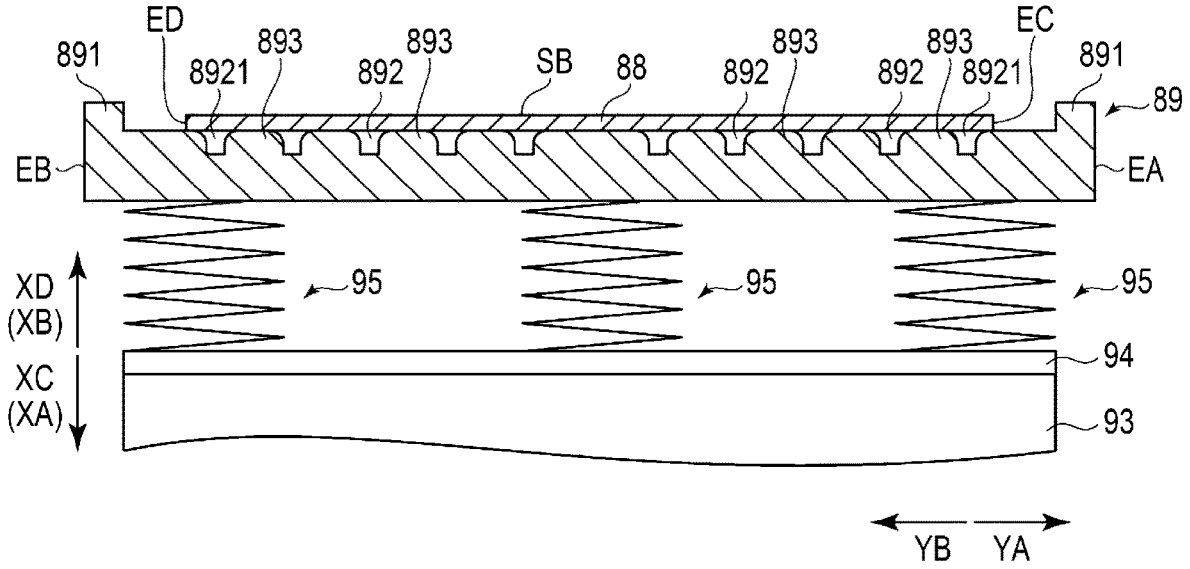
FIG. 4 is a schematic diagram illustrating a cross-section of the fixing device illustrated in FIG. 3, as taken along the line IV-IV.
Figure 5:
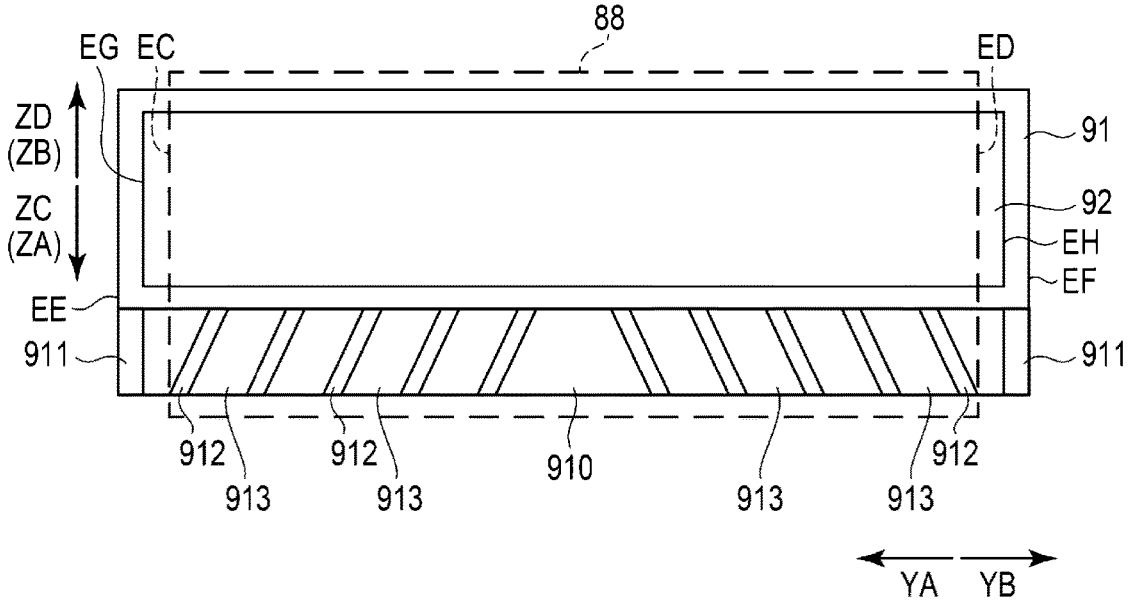
FIG. 5 is a schematic diagram illustrating the fixing device from the opposite direction of FIG. 3 with the exterior body and a rotating portion omitted.

As illustrated in FIG. 2, when the fixing device 20 is viewed along the arrow YB, a rotating member 85 clockwisely rotates and a fixing member 88 counter-clockwisely rotates. FIG. 2 illustrates the fixing device 20 from one direction (YA or YB). FIG. 3 illustrates the fixing device 20 on a side opposite to an exterior body 811. FIG. 4 is a schematic diagram illustrating a cross section of the fixing device 20 taken along the line IV-IV of FIG. 3. FIG. 5 illustrates the fixing device 20 from an exterior body 812 side. In FIGS. 3 and 5, the exterior body 81 is omitted from the depiction, and also the area that is covered by the fixing member 88 is illustrated with a broken line.

As illustrated in FIG. 1, within the image forming device 1, the fixing device 20 is provided on the upper side of the image forming unit 19 in the vertical direction. The fixing device 20 is provided between the paper feed conveyance path 31 and the paper discharge conveyance path 32. The recording medium is carried in from the paper feed conveyance path 31 side along the conveyance direction to the fixing device 20. The recording medium is carried out from the fixing device 20 to the paper discharge conveyance path 32 side along the conveyance direction.

As illustrated in FIG. 2, the fixing device 20 includes the exterior body 81, the rotating portion 82, and the fixed portion 83. The exterior body 81 is an exterior portion of the fixing device 20. The rotating portion 82 and the fixed portion 83 are provided inside the exterior body 81. The exterior body 81 is comprised of one exterior body 811 disposed to face another exterior body 812. The exterior body 812 and exterior body 811 are substantially symmetrical with respect to one another.

Gaps 841 and 842 are formed between exterior body 811 and the exterior body 812. The gap 841 is a carry-in port through which a recording medium is carried into the fixing device 20. The gap 842 is a carry-out port through which a recording medium is carried out from the fixing device 20. The recording medium passes through the gap 841 from the paper feed conveyance path 31 and into the fixing device 20. The recording medium passes through the gap 842 to the paper discharge conveyance path 32.

The rotating portion 82 rotates by the rotation of the fixed portion 83 while being pressed toward the rotating portion 82. The rotating portion 82 is stored inside the exterior body 811. The rotating portion 82 includes the rotating member 85, a connection member 86, and an urging member 87. The rotating member 85 is formed, for example, in a cylindrical shape or a substantially cylindrical shape. The rotating member 85 is stored inside the exterior body 811 in a posture in which the central axis is along the page width (longitudinal) direction. The rotating member 85 rotates in one direction by being driven by a driving unit. The rotating member 85 has a size in which the rotating portion 82 can be stored inside the exterior body 811.

The connection member 86 extends from the lower side of the rotating member 85 to the upper side of the rotating member 85 in the conveyance direction (corresponding to the vertical direction in this instance). The lower end portion of the connection member 86 is connected to the exterior body 811 on the lower side of the rotating member 85. The upper end portion of the connection member 86 is connected to a front end portion of the urging member 87 on the upper side of the rotating member 85. In the connection member 86, the central portion along the conveyance direction conforms with the shape of the rotating member 85. In the present embodiment, the connection member 86 comes into contact with the rotating member 85 from a side opposite to the exterior body 812. Therefore, the central portion of the connection member 86 is formed in a convex shape toward the side opposite to the exterior body 812. The convex shape has an arc shape or a substantially arc shape.

The urging member 87 extends along the width (sheet thickness) direction. The urging member 87 is provided on the upper side than the rotating member 85 in the vertical direction. In the urging member 87, a front end portion on the exterior body 812 side is connected to the upper end portion of the connection member 86. In the urging member 87, the rear end portion on the side opposite to the front end portion is connected to the exterior body 811. The urging member 87 urges the connection member 86 in the direction toward the exterior body 812. The urging member 87 is, for example, a spring.

The fixed portion 83 fixes the toner to the recording medium. The fixed portion 83 is stored inside the exterior body 812. The fixed portion 83 includes the fixing member 88, a pressing member 89, a holder 91, a heating member 92, a frame 93, a pedestal 94, and an urging member 95. The fixing member 88 is formed in a tubular shape. The fixing member 88 is in contact with the outer peripheral surface of the rotating member 85 from the exterior body 812 side. The dimension of the fixing member 88 is a size in which the fixed portion 83 can be stored inside the exterior body 812.

For example, the fixing member 88 includes a base material, an elastic layer provided on the outer peripheral side of the base material, and a surface layer provided on the outer peripheral side of the elastic layer. For example, the surface layer is provided on the outermost peripheral side of the fixing member 88 and is in contact with the recording medium. The base material is a thin film layer in a cylindrical shape. The thin film layer is formed with, for example, a resin (heat-resistant resin), stainless steel, a nickel-based metal material, polyimide, or the like. The thickness of the thin film layer is, for example, about 20 μm to 50 μm. The elastic layer is formed by using, for example, silicone rubber. The thickness of the elastic layer is about 200 μm to 300 μm. The surface layer is formed, for example, with a perfluoroalkoxy (PFA) resin. The thickness of the surface layer is about 20 μm. For example, the elastic layer is covered with the surface layer.

The pressing member 89 extends in a circumferential direction of the fixing member 88 along an inner peripheral surface SA of the fixing member 88 and extends in the longitudinal direction along the inner peripheral surface SA of the fixing member 88. An outer peripheral surface SB of the pressing member 89 is in contact with the inner peripheral surface SA of the fixing member 88. The pressing member 89 extends from an end portion TA on the gap 842 side (carry-out side) to an end portion TB on the gap 841 side (carry-in side) in the circumferential direction along the inner peripheral surface SA. The pressing member 89 extends in the circumferential direction of the fixing member 88 to a length at which the fixing member 88 can maintain an unrecessed shape towards the inner peripheral side. The extension length of the pressing member 89 is set based on the material, the size, and the like of the fixing member 88. The pressing member 89 is formed by using a resin of which the melting point is 180° C. or higher.

In the pressing member 89, a lubricant storage unit 90 is provided near the end portion TB on the carry-in side. The lubricant storage unit 90 absorbs the lubricant that is applied to the inner peripheral surface SA of the fixing member 88 and stores the lubricant. The lubricant storage unit 90 thus supplies the stored lubricant to the inner peripheral surface SA of the fixing member 88 and stabilizes the amount of the lubricant present on the inner peripheral surface SA. The lubricant storage unit 90 is provided on the outer peripheral surface SB of the pressing member 89. The lubricant storage unit 90 extends in the circumferential direction of the fixing member 88 and extends in the longitudinal direction along the inner peripheral surface SA of the fixing member 88. The lubricant storage unit 90 is formed of felt or a felt-like material, for example.

The holder 91, the heating member 92, the frame 93, the pedestal 94, and the urging member 95 are disposed on the inner peripheral side of the inner peripheral surface SA of the fixing member 88. In the fixed portion 83, the heating member 92, the holder 91, the frame 93, the pedestal 94, and the urging member 95 are provided in a row (in this order) from the rotating member 85 side to the pressing member 89 side. The urging member 95 is provided on the inner peripheral side of the pressing member 89.

The heating member 92 is attached to the holder 91. The holder 91 includes a support portion 910 that supports the heating member 92 from the carry-in side. The support portion 910 is in contact with the inner peripheral surface SA of the fixing member 88 from the inner peripheral side. The holder 91 is provided between the heating member 92 and the frame 93. The holder 91 is formed, for example, with a heat-resistant resin.

The heating member 92 can heat the fixing member 88 by being in contact with the fixing member 88. The heating member 92 is in contact with the inner peripheral surface SA of the fixing member 88 on a side where the rotating member 85 is positioned. The heating member 92 faces the rotating member 85. The heating member 92 is provided at a position where the fixing member 88 and the rotating member 85 are in contact with each other. In the heating member 92, a heat generating layer that generates heat when supplied with electric power is provided, for example, on the surface that is in contact with the inner peripheral surface SA.

The frame 93 is attached to the holder 91 from a side opposite to the rotating member 85 with respect to the width direction of the fixing device 20. The frame 93 is provided with a thermistor or a thermostat. The thermistor is a temperature detecting sensor for controlling the temperature of the heating member 92 based on the detected temperature of the fixing member 88. A thermostat prevents the heating member 92 from overheating by cutting off power when a threshold temperature is reached.

The pedestal 94 attaches the urging member 95 to the frame 93. The pedestal 94 includes a plate-shaped portion. The plate-shaped portion is attached to the frame 93 in the width direction of the fixing device 20. The plate-shaped portion bends from the carry-out side to the frame 93 at the end on the carry-out side. Therefore, when being viewed from one of the longitudinal directions of the fixing device 20, the pedestal 94 is formed in an L shape or a substantially L shape.

The urging member 95 is provided in the fixed portion 83 in an orientation along the width direction of the fixing device 20. The urging member 95 can be expanded and contracted in the width direction of the fixing device 20. One end of the urging member 95 is connected to the pedestal 94. The other end of the urging member 95 is connected to the pressing member 89. The pressing member 89 is urged toward the inner peripheral surface SA of the fixing member 88 by the urging member 95. One or a plurality of urging members 95 may be provided in the fixing device 20. For example, as illustrated in FIG. 4, three urging members 95 are provided in a row along the longitudinal direction.

As illustrated in FIG. 2, the fixing device 20 includes the peeling portion 96. The peeling portion 96 peels (separates) the recording medium from the fixing member 88. The peeling portion 96 is, for example, a peeling claw. The terminal end of the peeling portion 96 is rotatably attached to the exterior body 812. The tip end of the peeling portion 96 faces the carry-in side. The tip end of the peeling portion 96 is in contact with the outer peripheral surface of the fixing member 88 from the carry-out side. The tip end of the peeling portion 96 is preferably in contact with the outer peripheral surface of the fixing member 88 on the carry-out side of the end portion TA of the pressing member 89. In this case, the end portion TA of the pressing member 89 is positioned between the tip end of the peeling portion 96 and the heating member 92.

As illustrated in FIG. 3, the pressing member 89 extends to the outer side beyond end portions EC and ED of the fixing member 88. The dimension of the pressing member 89 in the longitudinal direction is greater than the dimension of the fixing member 88 in the longitudinal direction. An end portion EA of the pressing member 89 in the longitudinal direction is positioned on the outer side of an end portion EC of the fixing member 88 in the longitudinal direction. An end portion EB on a side opposite to the end portion EA of the pressing member 89 is positioned on the outer side of the end portion ED on a side opposite to the end portion EC of the fixing member 88. Accordingly, the pressing member 89 includes areas beyond the end portions EC and ED of the fixing member 88 on both sides of the pressing member 89.

As illustrated in FIG. 4, in the pressing member 89, the end portions EA and EB are formed with a pair of regulating portions 891. The possible deviation of the fixing member 88 along the longitudinal direction past the end portions EA and EB is regulated by the pair of regulating portions 891. The pair of regulating portions 891 are formed along the end portions EA and EB. The pair of regulating portions 891 project from the pressing member 89 toward the outer peripheral side of the fixing member 88. The pair of regulating portions 891 are formed over the entire length of the extension portion in the circumferential direction of the pressing member 89. While the pair of regulating portions 891 is configured to regulate the deviation of the fixing member 88 in the longitudinal direction, the present embodiment is not limited thereto. For example, the pair of regulating portions 891 can be formed in a portion of the extension portion of the pressing member 89 in the circumferential direction.

As illustrated in FIGS. 3 and 4, a plurality of grooves 892 are formed in the pressing member 89. Contact portions 893 are formed in the adjacent grooves 892. The contact portions 893 are in contact with the inner peripheral surface SA of the fixing member 88. The width of each groove 892 is smaller than the width of the contact portion 893. The grooves 892 angle toward the center of the pressing member 89 in the longitudinal direction as they go from the carry-out side to the carry-in side (from the end portion TA to the end portion TB) in the circumferential direction of the fixing member 88. That is, the grooves 892 are incident on the end portions EA and EB. The fixing member 88 rotates in the directions of the arrows of FIG. 2. Therefore, the grooves 892 are positioned on the inner side with respect to the longitudinal direction toward the downstream side of the rotation direction of the fixing member 88.

Grooves (first grooves) 8921 are formed on the outermost side of the plurality of grooves 892 with respect to the longitudinal direction. The grooves 8921 include outer extension end portions GA, inner extension end portions GB, and extension portions GC. The outer extension end portions GA are provided on the outer side of the end portion EC (ED). The inner extension end portions GB are provided on the inner side of the end portion EC (ED) and on the carry-in side of the outer extension end portions GA with respect to the conveyance direction. The extension portions GC extend between the outer extension end portions GA and the inner extension end portions GB. The extension portions GC intersect the end portion EC (ED) to be incident on the end portion EC (ED). For example, the plurality of grooves 892 are formed symmetrically or substantially symmetrically about the center with respect to the longitudinal direction. Among the plurality of grooves 892, the grooves 892 formed on one side axis of symmetry (centerline) are formed to be parallel or substantially parallel to each other. The opening edges of the grooves 892 and 8921 may be chamfered. Accordingly, the fixing member 88 can be prevented from bending at the opening edge.

In the groove 8921, the entire portion positioned on the outer extension end portion GA side in the intersection between the extension portion GC and the end portion EC (ED) is formed on the outer side from the end portion EC (ED). In the groove 8921, the entire portion positioned on the inner extension end portion GB side from the intersection between the extension portion GC and the end portion EC (ED) is formed on the inner side of the end portion EC (ED). In this case, the grooves 8921 (the extension portions GC) are configured with portions only on the outer side and portions formed only on the inner side with the end portion EC (ED) of the fixing member 88 taken as a boundary.

As illustrated in FIG. 5, the dimension of the holder 91 in the longitudinal direction is larger than the dimension of the fixing member 88 in the longitudinal direction. An end portion EE of the holder 91 is positioned on the outer side of the end portion EC of the fixing member 88 in the longitudinal direction. An end portion EF on a side opposite to the end portion EE of the holder 91 is positioned on the outer side of the end portion ED of the fixing member 88. Therefore, the holder 91 includes areas on the outside of the end portion EC and the end portion ED of the fixing member 88 on both sides of the holder 91. In the holder 91, the end portions EE and EF are formed from a pair of regulating portions 911. The deviation of the fixing member 88 from the end portions EE and EF of the holder 91 with respect to the longitudinal direction is regulated by the pair of regulating portions 911. As illustrated in FIG. 1, the pair of regulating portions 911 project from the holder 91 toward the outer peripheral side of the fixing member 88. The pair of regulating portions 911 are formed in the support portion 910 positioned on the carry-in side.

As illustrated in FIG. 5, the dimension of the heating member 92 in the longitudinal direction is larger than the dimension of the fixing member 88 in the longitudinal direction. An end portion EG of the heating member 92 is positioned on the outer side with respect to the longitudinal direction from the end portion EE of the fixing member 88. An end portion EH on a side opposite to the end portion EG of the heating member 92 is positioned on the outer side with respect to the longitudinal direction from the end portion ED on the side opposite to the end portion EC of the fixing member 88. The dimension of the heating member 92 in the longitudinal direction is smaller than the dimension of the holder 91 in the longitudinal direction. Therefore, the end portion EG (EH) of the heating member 92 is positioned between the end portion EC (ED) and the end portion EE (EF) with respect to the longitudinal direction.

Grooves (second grooves) 912 are formed in the holder 91. The contact portions 913 are formed between the adjacent grooves 912. The contact portions 913 are in contact with the inner peripheral surface SA of the fixing member 88. The grooves 912 angle toward the center of the holder 91 as they go from the carry-in port side to the carry-out port side in the circumferential direction of the fixing member 88. That is, the grooves 912 are incident on the end portions EE and EF of the holder 91. The plurality of grooves 912 are symmetrically or substantially symmetrically about the centerline of the holder 91 in the longitudinal direction. Among the plurality of grooves 912, the grooves 912 formed to one side of the centerline is formed to be parallel or substantially parallel to each other.

In the fixing device 20, one end of the connection member 86 is rotatably connected to the exterior body 811. The other end on a side opposite to one end of the connection member 86 is rotatably connected to the urging member 87. The connection member 86 is in contact with the rotating member 85 from the side opposite to the fixed portion 83 with respect to the width direction of the fixing device 20. The urging member 87 urges the other end of the connection member 86 toward the fixed portion 83 side of the fixing device 20. One end of the connection member 86 is connected to the exterior body 811 and does not move. Therefore, the connection member 86 is urged in a counter clockwise rotating state about the axis line that passes through the connection portion between the connection member 86 and the exterior body 811 in the longitudinal direction. Accordingly, the connection member 86 presses the rotating member 85 toward the fixed portion 83. Accordingly, the rotating member 85 is urged in a state of being toward the fixed portion 83. In this manner, the rotating member 85 is pressed toward the fixing member 88 in one direction of the width directions.

In the fixed portion 83, the pressing member 89, the urging member 95, the pedestal 94, the frame 93, the holder 91, and the heating member 92 are provided on the inner peripheral side of the inner peripheral surface SA of the fixing member 88 in the width direction of the fixing device 20 in this order. The heating member 92 is provided to be closest to the rotating member 85 with respect to the width direction of the fixing device 20 on the inner peripheral side from the inner peripheral surface SA of the fixing member 88. The pressing member 89 is provided to be farthest from the rotating member 85 with respect to the width direction of the fixing device 20 on the inner peripheral side of the inner peripheral surface SA of the fixing member 88. One end of the urging member 95 is connected to the pressing member 89. The other end on the side opposite to the one end of the urging member 95 is connected to the pedestal 94. The pedestal 94 is attached to the frame 93. The frame 93 is attached to the holder 91 that stores the heating member 92. The urging member urging 95 urges the pressing member 89 in a direction from the inner peripheral surface SA of the fixing member 88 toward the outer peripheral surface and urges the pedestal 94 in the direction opposite to the direction of urging the pressing member 89. That is, the pedestal 94 is urged in a direction from the pedestal 94 toward the rotating member 85 with respect to the width direction of the fixing device 20. Accordingly, the pedestal 94 presses the frame 93, the holder 91, and the heating member 92 toward the rotating member 85 side with respect to the width direction of the fixing device 20. Accordingly, the heating member 92 presses the inner peripheral surface SA of the fixing member 88 toward the rotating member 85 side. Accordingly, the fixing member 88 projects toward the outer peripheral side of the fixing member 88 by the pressing member 89 and the heating member 92.

In this manner, in the fixing device 20, the rotating member 85 is pressed toward the fixing member 88 from one direction of the width directions, and also the fixing member 88 projects the fixing member 88 toward the outer peripheral side. According to the deformation of the contact portion between the rotating member 85 and the fixing member 88, a nip is formed. According to the driving of the driving unit, if the rotating member 85 rotates about the axis in the longitudinal direction, the fixing member 88 rotates about an axis along the longitudinal direction by the friction between the rotating member 85 and the fixing member 88 at the nip. If the rotating member 85 rotates in one direction, the fixing member 88 rotates in a direction opposite to the rotation direction of the rotating member 85. When the fixing device 20 is viewed along the arrow YB with respect to the longitudinal direction, the rotating member 85 clockwisely rotates, and the fixing member 88 counter-clockwisely rotates.

When the fixing member 88 counter-clockwisely rotates as described above, the outer peripheral surface SB of the pressing member 89 is pressed toward the inner peripheral surface SA of the fixing member 88. At this point, the inner peripheral surface SA of the fixing member 88 slides on the outer peripheral surface SB of the pressing member 89. The inner peripheral surface SA of the fixing member 88 is coated with the lubricant. The entire surface of the inner peripheral surface SA of the fixing member 88 is coated with the lubricant in advance. When the fixing member counter-clockwisely rotates, the lubricant is introduced between the inner peripheral surface SA of the fixing member 88 and the outer peripheral surface SB of the pressing member 89. The grooves 892 are formed on the outer peripheral surface of the pressing member 89 in the shape as described above. Therefore, as the lubricant moves in the rotation direction according to the rotation of the fixing member 88, the lubricant moves along in the direction in which the grooves 892 extend. That is, the lubricant moves in the rotation direction of the fixing member 88 and moves toward the inner side in the longitudinal direction.

The lubricant storage unit 90 is provided in the end portion TB of the pressing member 89. The grooves 892 extend to the lubricant storage unit 90. That is, the lubricant moves to the lubricant storage unit 90 along the grooves 892 according to the rotation of the fixing member 88. The lubricant storage unit 90 absorbs at least a portion of the lubricant. Meanwhile, as the inner peripheral surface SA of the fixing member 88 passes through the lubricant storage unit 90, the lubricant storage unit 90 applies the lubricant in a predetermined amount to the inner peripheral surface SA of the fixing member 88. Accordingly, the inner peripheral surface SA of the fixing member 88 is coated with an appropriate amount of the lubricant. If the viscosity of the lubricant is low, the lubricant storage unit 90 is preferably provided in the pressing member 89.

The grooves 8921 include the outer extension end portions GA, the inner extension end portions GB, and the extension portions GC that extend between the outer extension end portions GA and the inner extension end portions GB. The extension portions GC are connected to the end portions EC and ED and intersect the end portions EC and ED. In addition, the grooves 8921 are angled toward the inner side with respect to the longitudinal direction as they go around the rotation direction of the fixing member 88 in the same manner as the other grooves 892. Therefore, if the lubricant protruding from the end portions EC and ED toward the outer side in the longitudinal direction moves in the rotation direction with the rotation of the fixing member 88, the lubricant moves in the direction in which the grooves 8921 extend. The grooves 8921 extend to the lubricant storage unit 90. Therefore, the lubricant moves to the lubricant storage unit 90 along the grooves 8921 according to the rotation of the fixing member 88. In this manner, the grooves 8921 can move the lubricant protruding from the end portions EC and ED of the fixing member 88 to the lubricant storage unit 90. Accordingly, the leakage of the lubricant from the fixing member 88 can be limited.

The holder 91 is urged toward the rotating member 85 with respect to the width direction of the fixing device 20 by the urging member 95. Therefore, the surface of the support portion 910 on the rotating member 85 side is pressed toward the inner peripheral surface SA of the fixing member 88. The grooves 912 are formed on the surface of the support portion 910. The grooves 912 are angled toward the inner side in the longitudinal direction as they go around in the rotation direction of the fixing member 88. Therefore, the grooves 912 can bring the lubricant of the fixing member 88 on the inner peripheral surface to the inner side in the longitudinal direction in the same manner as in the grooves 892.

In the fixing device 20 according to the present embodiment, the grooves 8921 that extend in the circumferential direction of the fixing member 88 are formed in the pressing member 89. The grooves 8921 include the outer extension end portions GA, the inner extension end portions GB, and the extension portions GC. The outer extension end portions GA are provided on the outside of the end portions EC and ED of the fixing member 88. The inner extension end portions GB are provided on the inside end portions EC and ED of the fixing member 88 in the longitudinal direction. The extension portions GC extend between the outer extension end portions GA and the inner extension end portions GB. The extension portions GC are positioned on the inside toward the downstream side of the fixing member 88 in the rotation direction, and intersect the end portions EC and ED of the fixing member 88. Accordingly, as described above, even when the fixing member 88 is rotationally driven, the leakage of the lubricant applied to the inner peripheral surface SA of the fixing member 88 is prevented.

In the fixing device 20, the pressing member 89 preferably includes the regulating portions 891 that project outward toward the fixing member 88 at the end portions EE and EF. Accordingly, as described above, even when the fixing member 88 is rotationally driven, the movement of the fixing member 88 over the end portions EE and EF with respect to the longitudinal direction of the fixing device 20 can be prevented.

The fixing device 20 preferably includes a lubricant storage unit 90. The lubricant storage unit 90 extends along the longitudinal direction of the fixing device 20 and is provided in the end portion TB that is positioned on the carry-in side in the pressing member 89. Accordingly, even when the fixing member 88 is rotationally driven, the lubricant storage unit 90 stores lubricant applied to the inner peripheral surface SA of the fixing member 88, and thus the leakage of the lubricant applied to the inner peripheral surface SA of the fixing member 88 is limited. In addition, when the lubricant applied to the inner peripheral surface SA of the fixing member 88 becomes exhausted, the lubricant storage unit 90 can supply lubricant to the inner peripheral surface SA of the fixing member 88. Therefore, the sliding between the inner peripheral surface SA of the fixing member 88 and the outer peripheral surface SB of the pressing member 89 is kept in a low friction state.

The fixing device 20 preferably includes the holder 91 to which the heating member 92 is attached. The holder 91 includes the support portion 910 that is in contact with the inner peripheral surface SA of the fixing member 88 and supports the heating member from the carry-in side in the conveyance direction. Accordingly, when the fixing member 88 is rotationally driven, the fixing member 88 projects toward the fixing member 88 from the pressing member 89, the heating member 92, and the support portion 910, and thus the fixing member 88 is maintained in an appropriate posture.

In the fixing device 20, the grooves 912 that extend along the circumferential direction of the fixing member 88 are preferably formed in the support portion 910. Accordingly, when the fixing member 88 is rotationally driven, the leakage of the lubricant applied to the inner peripheral surface SA of the fixing member 88 is avoided.

The fixing device 20 preferably includes a peeling portion 96 that peels the recording medium from the fixing member 88. In the pressing member 89, the end portion TA that is positioned on the carry-out side in the conveyance direction is positioned between the tip end of the peeling portion 96 and the heating member 92. Accordingly, the peeling portion 96 can appropriately peel the recording medium from the fixing member 88.

(Modification)

Figure 6:
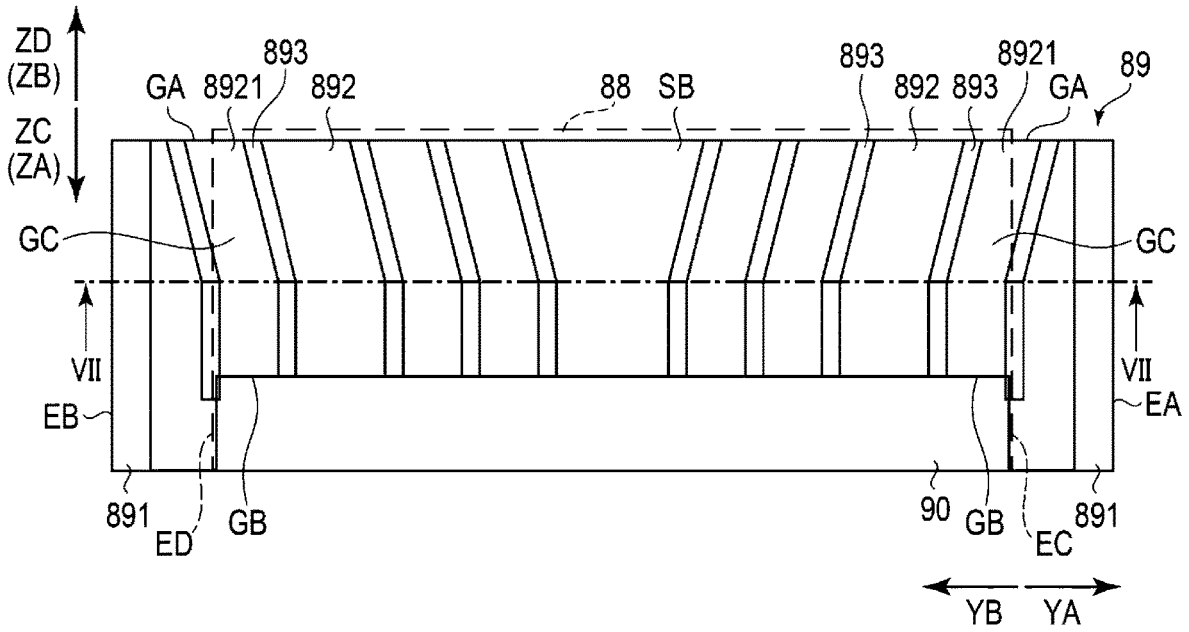
FIG. 6 is a schematic diagram illustrating a fixing device according to a modification of an embodiment with the exterior body omitted.
Figure 7:
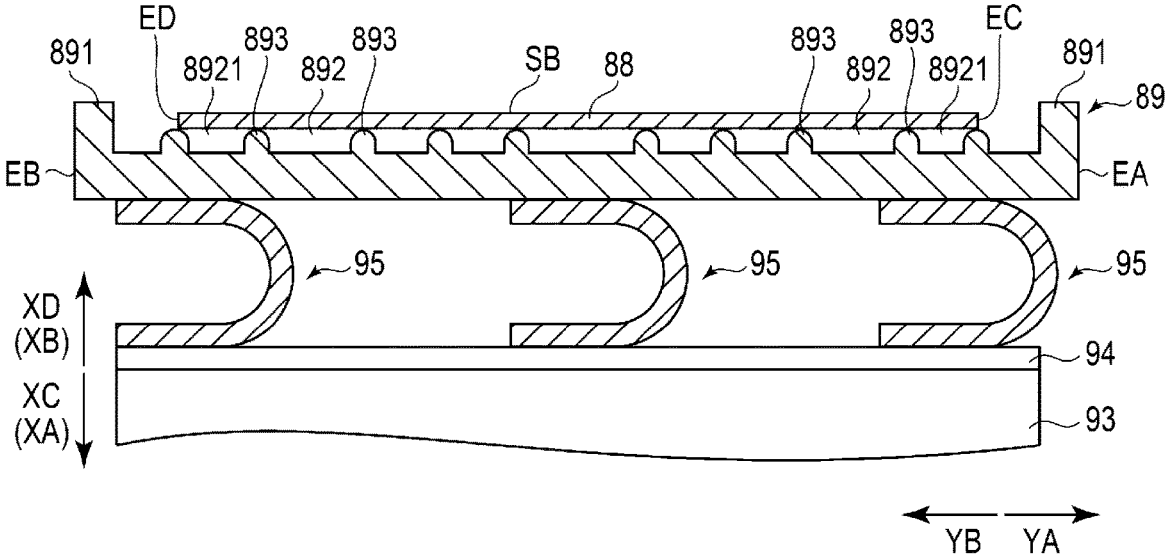
FIG. 7 is a schematic diagram illustrating a cross-section of the fixing device illustrated in FIG. 6 as taken along the line VII-VII.
Figure 8:
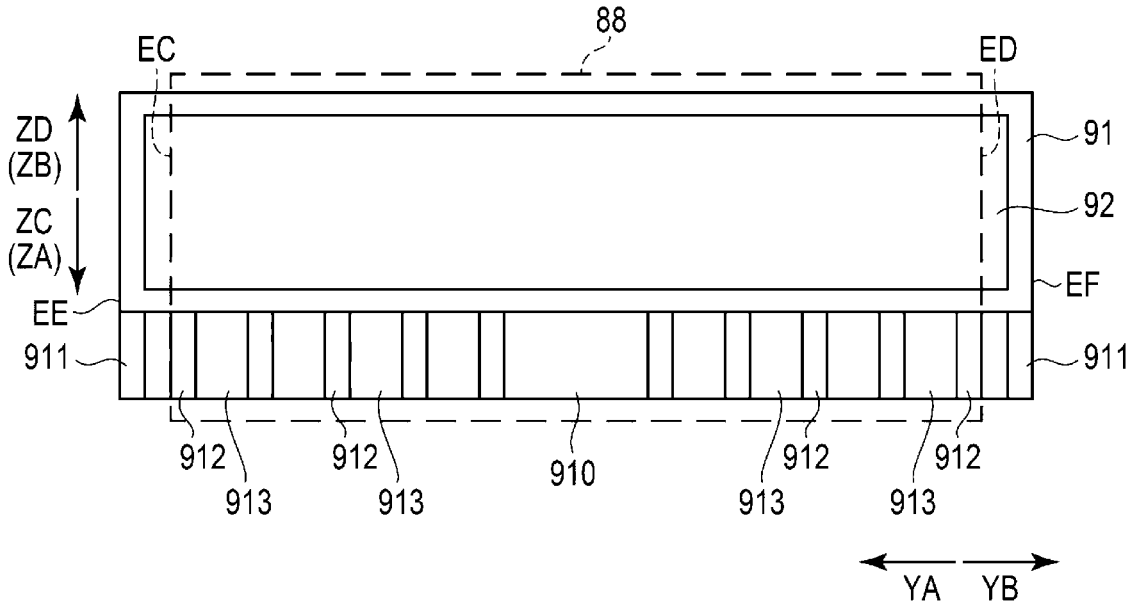
FIG. 8 is a schematic diagram illustrating the fixing device according to the modification of an embodiment from the opposite direction of FIG. 6 with the exterior body and the rotating portion omitted.

FIGS. 6 to 8 are schematic diagrams illustrating a fixing device 20 according to a modification of the above embodiment. FIG. 6 illustrates the fixing member 88 provided in the fixing device 20 as viewed from the side opposite to the rotating portion 82 from the width direction of the fixing device 20. In the modification, the shapes of the grooves 892 and the grooves 8921 are different from those of the grooves 892 and the grooves 8921 according to the above embodiment. The grooves 892 according to the modification extend toward the center of the pressing member 89 as they goes along the circumferential direction of the fixing member 88 from the carry-out side to the carry-in side and bend toward the lubricant storage unit 90 at a position where it advances in a predetermined length in the circumferential direction of the fixing member 88. The grooves 8921 are bent at least one of portions between the positions where the extension portions GC intersect the end portion EC (ED) of the fixing member 88 and the outer extension end portions GA and portions between the positions where the extension portions GC intersect the end portion EC (ED) of the fixing member 88 and the inner extension end portions GB. In the grooves 8921 of the present modification, the extension portions GC bend to a portion on the lubricant storage unit 90 side between positions where the extension portions GC intersect the end portion EC (ED) of the fixing member 88 and the inner extension end portions GB. The grooves 8921 extend in the circumferential direction of the fixing member 88 on the carry-in side from the bending portion.

FIG. 7 illustrates a cross section of the fixing device 20 illustrated in FIG. 6 taken along the line VII-VII. In the modification, the shape of the urging member 95 is different from the urging member 95 according to the above embodiment. Also in the modification, the urging member 95 connects the pressing member 89 and the pedestal 94. However, the urging member 95 is folded back in one direction in the longitudinal direction between the pressing member 89 and the pedestal 94. That is, the urging member 95 is formed in a U shape or a substantially U shape when being viewed in the conveyance direction. In the modification, the widths of the grooves 892 and 8921 in the longitudinal direction are larger than the widths of the contact portions 893 in the longitudinal direction.

FIG. 8 illustrates the holder 91 provided in the fixing device 20 as viewed from the rotating portion 82 side from the width direction of the fixing device 20. In the modification, the shapes of the grooves 912 formed in the holder 91 are different from those of the grooves 912 according to the above embodiment. The grooves 912 according to the modification extend in the circumferential direction of the fixing member 88 from the carry-in side to the carry-out side. That is, the grooves 912 are formed along the circumferential direction of the fixing member 88.

Also in the modification, in the grooves 8921 formed in the pressing member 89, the extension portions GC extend between the outer extension end portions GA and the inner extension end portions GB. The extension portions GC are positioned to inside direction toward the downstream side of the fixing member 88 in the rotation direction, and intersect the end portions EC and ED of the fixing member 88. Accordingly, the same effects as in the above embodiment are exhibited in the modification, and also the following effects are exhibited.

In the grooves 892 of the modification, the extension portions GC bend toward the lubricant storage unit 90 at a position where it advances in a predetermined length along the circumferential direction of the fixing member 88. In addition, in the grooves 8921 of the modification, the extension portions GC are bent in at least one of the portions between the positions where the end portion EC (ED) and the extension portions GC intersect each other and the outer extension end portions and the portions between the positions where the end portion EC (ED) and the extension portions GC intersect each other and the inner extension end portions. Accordingly, the lubricant that moves along the grooves 892 and 8921 moves in the circumferential direction of the fixing member 88 due to the bending of the grooves 892 and 8921. Accordingly, the lubricant applied to the inner peripheral surface of the fixing member 88 moves along the circumferential direction while being collected toward a predetermined position along the longitudinal direction by the grooves 892 and 8921. Accordingly, the lubricant is easily applied to the entire inner peripheral surface of the fixing member 88 uniformly or substantially uniformly without deviation.

In the modification, the grooves 912 extend along the circumferential direction of the fixing member 88. Accordingly, the lubricant applied to the inner peripheral surface of the fixing member 88 easily moves in the circumferential direction of the fixing member 88 along the grooves 912. Accordingly, the lubricant is well applied to the entire inner peripheral surface of the fixing member 88 uniformly or substantially uniformly without deviation.

According to an embodiment, in a fixing device, the grooves that extend in the circumferential direction of a fixing member are formed in a pressing member that is in contact with the inner peripheral surface of the fixing member. The grooves include outer extension end portions, inner extension end portions, and extension portions. Each outer extension end portion is provided to the outside in the longitudinal direction from an end portion of the fixing member. The inner extension end portion is provided to the inside of the end portion of the fixing member. An extension portion extends between the outer extension end portion and the inner extension end portion The extension portion is positioned to the inside along the longitudinal direction toward the downstream side of the fixing member in the rotation direction. The extension portion also intersects to an end portion of the fixing member.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. A fixing device for an image forming apparatus, the fixing device comprising:

a fixing member having a tubular shape and an inner surface coated with lubricant;

a rotating member configured to contact an outer surface of the fixing member and rotate the fixing member;

a heating member on an inner surface side of the fixing member at a first position and configured to heat the fixing member; and a pressing member configured to press outward against the inner surface of the fixing member at a second position separated from the first position, the pressing member extending in a longitudinal direction beyond outer edges of the fixing member, wherein the pressing member includes a plurality of first grooves in an outward facing surface contacting the inner surface of fixing member, and the plurality of first grooves includes at least one first groove that has:

an outer extension end portion that extends beyond an outer edge of the fixing member, an inner extension end portion at a position inside the outer edges of the fixing member, and an extension portion connecting the outer extension end portion and the inner extension end portion, the extension portion including an angled portion that is angled inward toward a center of the fixing member in the longitudinal direction, the angled portion being angled towards a downstream direction of the fixing member along a rotational direction of the fixing member, the extension portion crossing the outer edge of the fixing member.

2. The fixing device according to claim 1, wherein the outer extension end portion is entirely outside the outer edge of the fixing member.

3. The fixing device according to claim 1, wherein the outer extension end portion, the extension portion, and the inner extension portion each extend at the same inward angle toward the center of the fixing member.

4. The fixing device according to claim 3, wherein the plurality of first grooves includes:

a first group on a first side of the center of the fixing member each extending in parallel to each other first groove in the first group, and a second group on a second side of the center of the fixing member each extending in parallel to each other, and the first and second groups are symmetric with each other about the center of the fixing member in the longitudinal direction.

5. The fixing device according to claim 1, wherein the inner extension portion extends parallel to the rotational direction of the fixing member.

6. The fixing device according to claim 5, wherein the plurality of first grooves includes:

a first group on a first side of the center of the fixing member each extending in parallel to each other first groove in the first group, and a second group on a second side of the center of the fixing member each extending in parallel to each other, and the first and second groups are symmetric with each other about the center of the fixing member in the longitudinal direction.

7. The fixing device according to claim 1, wherein the pressing member includes a regulating projection portion that protrudes outward from the pressing member, the regulating projection portion is at a position outside the outer edge of the fixing member, and the regulating projection portion is configured to prevent the fixing member from moving past the regulating projection portion in the longitudinal direction.

8. The fixing device according to claim 1, further comprising:

an urging member configured to press the pressing member outward toward the fixing member, wherein the heating member contacts the inner surface of the fixing member at a position facing the rotating member, the pressing member contacts the inner surface of the fixing member at a position that is on an opposite side from the position facing the rotating member.

9. The fixing device according to claim 8, wherein the urging member is between the heating member and the pressing member and presses the heating member towards the fixing member.

10. The fixing device according to claim 1, further comprising:

a lubricant storage region in the pressing member and configured to store lubricant, wherein the lubricant storage region is in an end portion of the pressing member facing towards the rotational direction of the fixing member, and the lubricant storage region is between the fixing member and a portion of the pressing member.

11. The fixing device according to claim 1, further comprising:

a holder configured to hold the heating member, wherein the holder is between the heating member and the pressing member, and the holder is in contact with the inner surface of the fixing member and includes a support portion that supports the heating member.

12. The fixing device according to claim 11, wherein a portion of the support portion contacting the inner surface of the fixing member includes a second groove that extends in the circumferential direction of the fixing member.

13. The fixing device according to claim 1, further comprising:

a peeling portion on an output side of the rotating member and configured to peel a recording medium from the fixing member, wherein the pressing member includes an end portion that is between the heating member and a tip end of the peeling portion.

14. An image forming apparatus, comprising:

an image forming unit configured to form a toner image on a sheet;

a fixing device configured to fix the toner image on the sheet from the image forming unit, the fixing device including:

a fixing member having a tubular shape and an inner surface coated with lubricant;

a rotating member configured to contact an outer surface of the fixing member and rotate the fixing member;

a heating member on an inner surface side of the fixing member at a first position and configured to heat the fixing member; and a pressing member configured to press the inner surface of the fixing member outward at a second position separated from the first position, the pressing member extending in a longitudinal direction beyond outer edges of the fixing member, wherein the pressing member includes a plurality of first grooves in an outward facing surface that contacts the fixing member, and the plurality of first grooves includes at least one first groove that includes:

an outer extension end portion that extends beyond an outer edge of the fixing member, an inner extension end portion at a position inside the outer edges of the fixing member, and an extension portion connecting the outer extension end portion and the inner extension end portion, the extension portion includes an angled portion angled inward toward a center of the fixing member in the longitudinal direction, the angled portion is angled towards a downstream direction of the fixing member along a rotational direction of the fixing member, and the extension portion crosses the outer edge of the fixing member.

15. The image forming apparatus according to claim 14, wherein the outer extension end portion is entirely outside the outer edge of the fixing member.

16. The image forming apparatus according to claim 14, wherein the outer extension end portion, the extension portion, and the inner extension portion each extend at the same inward angle toward the center of the fixing member.

17. The image forming apparatus according to claim 16, wherein the plurality of first grooves includes:

a first group on a first side of the center of the fixing member each extending in parallel to each other first groove in the first group, and a second group on a second side of the center of the fixing member each extending in parallel to each other, and the first and second groups are symmetric with each other about the center of the fixing member in the longitudinal direction.

18. The image forming apparatus according to claim 14, wherein the pressing member includes a regulating projection portion that protrudes outward from the pressing member, the regulating projection portion is at a position outside the outer edge of the fixing members, and the regulating projection portion is configured to prevent the fixing member from moving past the regulating projection portion in the longitudinal direction.

19. The image forming apparatus according to claim 14, further comprising:

an urging member configured to press the pressing member outward toward the fixing member, wherein the heating member contacts the inner surface of the fixing member at a position facing the rotating member, and the pressing member contacts the inner surface of the fixing member at a position that is on an opposite side from the position facing the rotating member.

20. The image forming apparatus according to claim 14, further comprising:

a lubricant storage region in the pressing member, the lubricant storage region and to store lubricant, wherein the lubricant storage region is in an end portion of the pressing member facing towards the rotational direction of the fixing member, and the lubricant storage region is between the fixing member and a portion of the pressing member.

* * * * *